US005562495A

United States Patent [19]

Kakitani et al.

[11] Patent Number: 5,562,495

[45] Date of Patent: Oct. 8, 1996

[54] ELECTRIC CONNECTOR

[75] Inventors: Yutaka Kakitani, Tokyo; Satoru Shindo, Yokohama; Yasuyuki Ueno, Tokyo, all of Japan

[73] Assignee: The Whitaker Corporation, Wilmington, Del.

[21] Appl. No.: 516,268

[22] Filed: Aug. 17, 1995

[30] Foreign Application Priority Data

Oct. 31, 1994 [JP] Japan ..... 6-290605

[51] Int. Cl.[6] ..... H01R 13/422; H01R 13/428

[52] U.S. Cl. ..... 439/595; 439/596; 439/871

[58] Field of Search ..... 439/595, 871, 439/596

[56] References Cited

U.S. PATENT DOCUMENTS 4,944,696 7/1990 Sueyoshi et al. ..... 439/595

FOREIGN PATENT DOCUMENTS 63-39874 2/1988 Japan .
4-220970 7/1992 Japan .

*Primary Examiner*—P. Austin Bradley
*Assistant Examiner*—Christopher Goins

[57] ABSTRACT

The object of the present invention is to provide an electrical connector in which a mechanism for preventing the incorrect insertion of terminals is part of the housing lances so that the incorrect insertion of terminals is prevented. Housing lances 6 are formed in the housing 2 of an electrical connector 1. The housing lances 6 have an inclined surface 8 which protrudes into cavities 4, and recesses 20, which accommodate projections 76 used to prevent the incorrect insertion of terminals 70, are formed in the inclined surfaces 8. Stop surfaces 22 which are contacted by the projections 76 are formed in the front portions of the recesses 20. As a result, further insertion of the terminals 70 is prevented so that incorrect insertion is prevented.

8 Claims, 2 Drawing Sheets

ELECTRIC CONNECTOR

FIELD OF INVENTION

The present invention concerns an electrical connector, especially an electrical connector which has a mechanism for preventing the incorrect insertion of electrical terminals.

BACKGROUND OF THE INVENTION

Conventionally, projections for the purpose of preventing incorrect insertion of electrical terminals have been formed on the terminals as a mechanism for detecting upside-down insertion, i.e., the so-called incorrect insertion, of the terminals. For example, electrical connectors of this type include the connector disclosed in Japanese Patent Publication No. 4-220970 as shown in FIG. 4. This electrical connector 100 has a housing 102 in which cavities 104 that accommodate terminals 150 are formed. Housing lances 106 which hold the terminals 150 in the cavities 104 by engaging with the terminals 150 are formed as part of the housing 102. The terminals 150 have projections 108 which are located on the opposite sides of the terminals 150 from the housing lances 106 when the terminals 150 are correctly inserted. These projections 108 are constructed so that when the terminals 150 are inserted upside down, i.e., when the terminals 150 are inserted into the cavities 104 with the projections 108 located on the lower sides of the terminals 150 with respect to the position shown in FIG. 4, the projections 108 contact the rear surface 110 of the housing 102 so that insertion is impossible. Alternatively, in cases where the cavities 104 have large dimensions capable of accommodating the projections 108, the projections 108 contact the stepped inclined surfaces 112 of double locking members 114 which form portions of the housing lances 106, so that further insertion of the terminals 150 is prevented.

In order to allow smooth insertion of the terminals, the portions of the housing lances 106 that project into the cavities are sometimes formed as gradually inclined surfaces, as for example in the electrical connector disclosed in Japanese UM Publication No. 63-37874. In such cases, there is a danger that the projections 108 used to prevent incorrect insertion may move forward along these gradually inclined surfaces without catching, thus passing the housing lances so that the terminals 150 are incorrectly inserted.

SUMMARY OF THE INVENTION

The present invention was devised in light of the above points. The object of the present invention is to provide an electrical connector which allows smooth insertion of the terminals thereinto when the terminals are inserted in their correct positions and which allows reliable detection of incorrect upside-down insertion of the terminals.

The electrical connector of the present invention is an electrical connector which is equipped with a housing provided with cavities into which terminals having projections that are used in order to prevent incorrect insertion are inserted, and housing lances having inclined surfaces that project into the cavities, and by which the terminals are held by the housing lances, the electrical connector includes stop members which prevent the insertion of the terminals when the terminals are inserted into the cavities upside down, as a result of projections on the terminals engaging recesses which accommodate the projections, as well as front surfaces of the recesses being stop surfaces.

BRIEF DESCRIPTION OF THE DRAWINGS

An embodiment of the invention will be described by way of example with reference to the accompanying drawings in which.

DETAILED DESCRIPTION OF THE INVENTION

Figure 1:
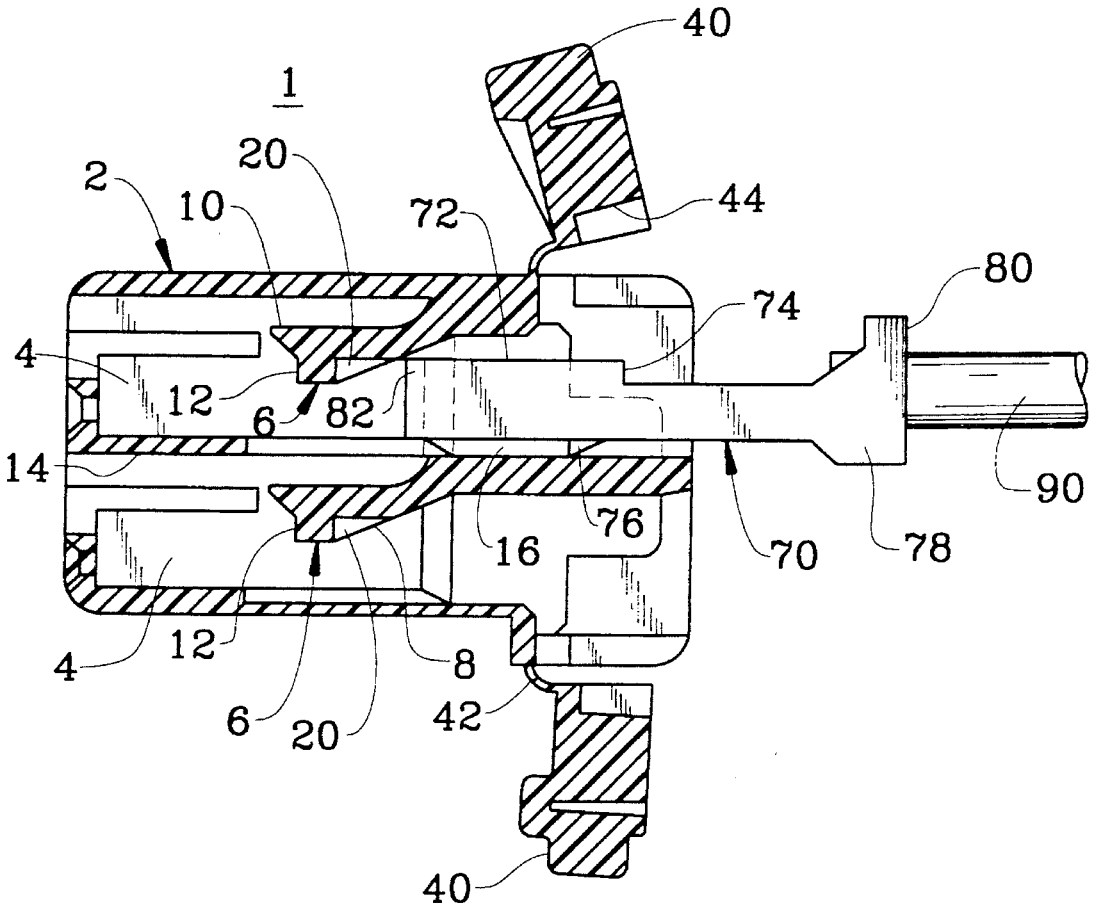
FIG. 1 shows a cross-sectional view of an electrical connector of the present invention together with a terminal.

FIG. 1 is a cross-sectional view of an electrical connector 1 of the present invention. However, terminal 70 which is connected to an electrical conductor 90 is not shown in cross section. The electrical connector 1 has a housing 2 in which cavities 4 and housing lances 6 that receive terminals 70 are formed. Each housing lance 6 has an inclined surface 8 which is gradually inclined and which projects into the interior of the corresponding cavity 4. A step section 12, which engages with a shoulder 74 formed on contact portion 72 of the corresponding terminal 70 is formed on a tip portion 10 of each housing lance 6. FIG. 1 shows a condition in which a terminal 70 is in the process of being correctly inserted into one of the cavities 4. A projection 76 is formed on each terminal 70 on the opposite side of the terminal 70 from the corresponding housing lance 6. This projection 76 is formed from the metal plate from which the terminal 70 is formed by stamping. The front end of the projection 76 has a rib shape which is substantially perpendicular to the direction of the insertion of the terminal 70. The projection 76 is constructed so that when the terminal 70 is correctly inserted, the projection 76 moves through a slot 16 formed in a partition wall 14 located between the cavities 4. A recess 20, which extends in the direction of insertion of the terminal 70, is formed in each housing lance 6. Furthermore, double locking members 40, which secondarily lock the terminals 70, are integrally connected to the housing 2 by hinges 42 and hold the terminals 70 by pressing against the rear ends 80 of the insulation barrels 78 of the terminals 70 with the front ends of the double locking members 40.

Figure 2:
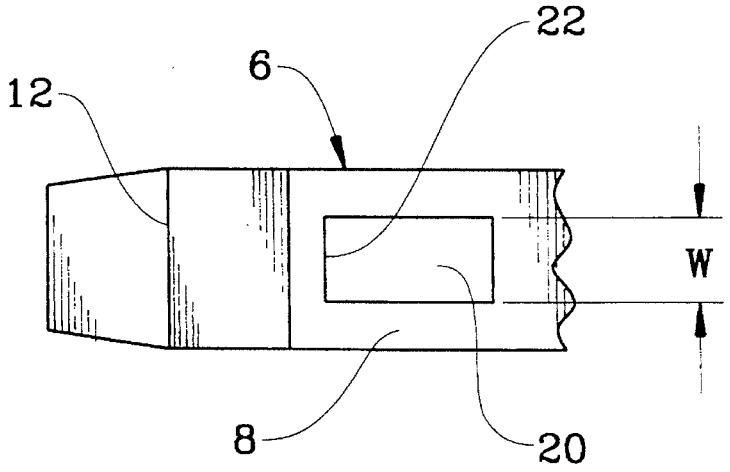
FIG. 2 is apart enlargement of the undersurface of one of the housing lances of the electrical connector shown in FIG. 1.

FIG. 2 shows a part enlarged view of the undersurface of one housing lance 6. A recess 20 is formed substantially in the central portion of the housing lance 6 with respect to the direction of width of the housing lance 6. As is seen from FIG. 1, the recess 20 becomes deeper toward the front, and the front end of the recess is closed so that a stop surface 22 is formed. Recess 20 has a triangular configuration in cross section. Stop surface 22 is substantially perpendicular to the direction of insertion of the terminal 70. It is sufficient if the width W of the groove 20 is a width which allows accommodation of the projection 76; however, this width W is narrower than the width of the terminal 70 as seen from the undersurface of the terminal 70. This is done in order to allow smooth movement of the terminal 70 along the inclined surface 8 without any catching of the corner portion 82 at the tip of the terminal 70 in the recess 20 when the terminal 70 is inserted correctly. In the present embodiment, the width W is set at approximately one half the width of the housing lance. Furthermore, this width W may also be set so that it gradually increases toward the right in FIG. 2, thus facilitating insertion of the projection 76 therein.

Figure 3:
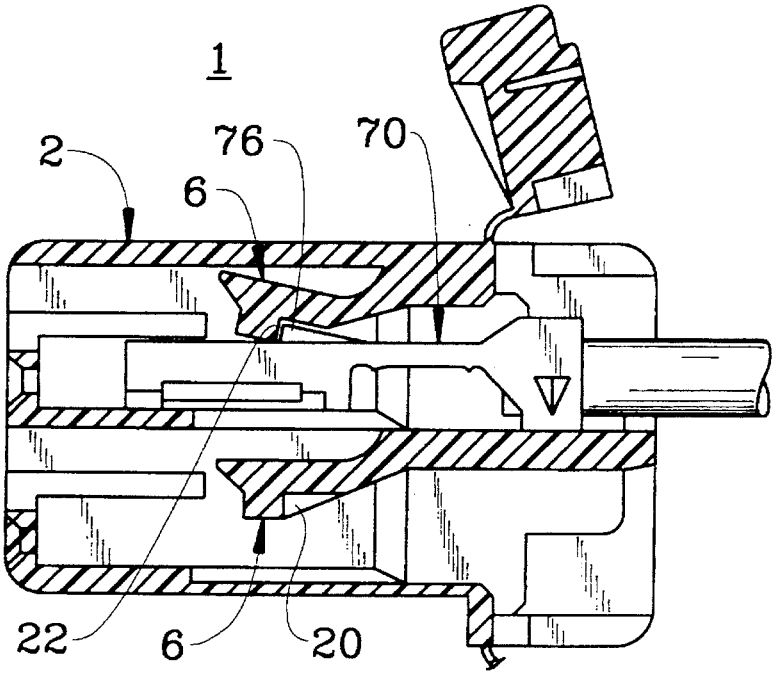
FIG. 3 is a cross-sectional view of an electrical connector of the present invention, illustrating a terminal has been incorrectly inserted.
Figure 4:
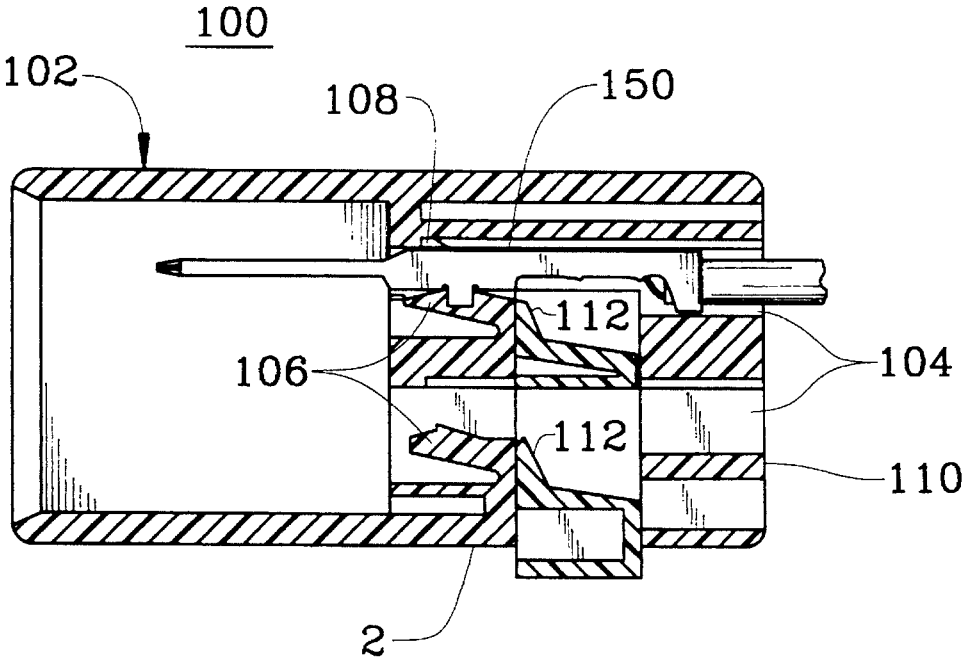
FIG. 4 PRIOR ART
FIG. 4 is a cross-sectional view of a conventional electrical connector.

FIG. 3 is a cross-sectional view similar to FIG. 1 which illustrates a terminal 70 which has been incorrectly inserted upside down. Since the projection 76 is located on the housing lance side of the terminal 70, the projection 76 enters the recess 20 of the housing lance 6 and engages the stop surface 22, so that further insertion of the terminal 70 is stopped. Accordingly, the worker does not receive the standard sensation obtained when a terminal is completely inserted; together with the insufficient amount of insertion, this lack of the abovementioned standard sensation allows the worker to detect the incomplete insertion of the terminal 70.

An embodiment of the present invention has been described above. However, it goes without saying that various modifications and alterations are possible within the spirit of the present invention. For example, the projection 76 is not limited to a rib-form projection; it would also be possible to form the projection by punching the metal plate so that a projection is formed. Furthermore, it would also be possible to use a multiple number of rib-form projections in order to increase the strength.

In the electrical connector of the present invention, recesses which accommodate projections used to prevent the incorrect insertion of terminals are formed in the inclined surfaces of housing lances, and stop surfaces are formed which prevent the incorrect insertion of the terminals as a result of the projections contacting the front surfaces of the recesses. Accordingly, the following advantages are obtained:

Specifically, the terminals can be smoothly inserted when the terminals are inserted correctly, and incorrect insertion can be reliably prevented when the terminals are inserted upside down.

We claim:

1. An electrical connector housing comprising a dielectric housing having terminal-receiving cavities into which electrical terminals including projections are to be inserted, housing lances extending into said terminal-receiving cavities for engagement with the electrical terminals thereby maintaining the electrical terminals in said terminal-receiving cavities, characterized in that said housing lances have recesses provided with stop surfaces for receiving the projections when the electrical terminals are inserted into said terminal-receiving cavities upside down thereby preventing the electrical terminals to be inserted into said terminal-receiving cavities.

2. An electrical connector housing as claimed in claim 1, wherein said recesses have a triangular configuration in cross section.

3. An electrical connector housing as claimed in claim 1, wherein double-locking members are integrally connected to said housing by hinges for engagement with the electrical terminals when positioned in said terminal-receiving cavities.

4. An electrical connector housing as claimed in claim 1, wherein said housing lances have inclined surfaces facing into said terminal-receiving cavities and along which said recesses extend.

5. An electrical connector housing as claimed in claim 1, wherein said housing lances have a step section at front ends thereof.

6. An electrical connector comprising a dielectric housing having terminal-receiving cavities therein, electrical terminals to be positioned in said terminal-receiving cavities, housing lances extending into said terminal-receiving cavities for engagement with said electrical terminals when properly positioned in said terminal-receiving cavities thereby maintaining said electrical terminals within said terminal-receiving cavities, characterized in that said housing lances have recesses for receiving projections at a bottom surface of said electrical terminals when the electrical terminals are inserted into said terminal-receiving cavities upside down thereby preventing said electrical terminals to be inserted into said terminal-receiving cavities.

7. An electrical connector as claimed in claim 6, wherein said housing lances have inclined surfaces facing into said terminal-receiving cavities.

8. An electrical connector as claimed in claim 7, wherein said recesses extend along said inclined surfaces and are triangular-shaped in cross section and have stop surfaces.

* * * * *